US007185801B2

(12) United States Patent
Session, Sr.

(10) Patent No.: US 7,185,801 B2
(45) Date of Patent: Mar. 6, 2007

(54) SOCK IN A SOCK

(75) Inventor: Gary Austin Session, Sr., 89 Coleman Rd. Unit 233, West Haven, CT (US) 06516

(73) Assignee: Gary Austin Session, Sr., West Haven, CT (US)

( * ) Notice: Subject to any disclaimer, the term of this patent is extended or adjusted under 35 U.S.C. 154(b) by 0 days.

(21) Appl. No.: 10/907,309

(22) Filed: Mar. 28, 2005

(65) Prior Publication Data

US 2006/0213963 A1 Sep. 28, 2006

(51) Int. Cl.
*A47B 81/00* (2006.01)

(52) U.S. Cl. ..... 232/1 B; 220/23.83; 220/495.06; 209/937

(58) Field of Classification Search ..... 232/1 B, 232/30–32; 383/117; 220/23.83, 495.06, 220/495.07; 209/937; D32/36, 37
See application file for complete search history.

(56) References Cited

U.S. PATENT DOCUMENTS 2,625,973 A * 1/1953 Weldon et al. ..... 206/459.5
2,736,454 A * 2/1956 McConnell ..... 220/23.2
D294,757 S * 3/1988 Kahane et al. ..... D32/36
4,739,880 A * 4/1988 Sawyer et al. ..... 206/223
5,253,775 A * 10/1993 Gould ..... 220/23.83
5,503,476 A * 4/1996 Hamdan ..... 383/9
5,540,501 A * 7/1996 Franco ..... 383/13
D410,120 S * 5/1999 Norman et al. ..... D32/36
6,760,943 B2 * 7/2004 Williams ..... 8/159
2005/0242248 A1 * 11/2005 Ryan ..... 248/95

* cited by examiner

*Primary Examiner*—William L. Miller

(57) ABSTRACT

A combined hamper and wash bag which provides a convenient arrangement for separating and maintaining separation of pairs of socks or small laundry items from large items prior to washing and throughout the washing and drying process. The bag comprises a mesh bag portion having one open end, having drawstrings for the closures, and zippers for closures. A center webbing, used to secure the several bags in place, and a hanging feature used for hanging the invention on a hook for easy access. The openings comprising the mesh bag are of adequate size to allow sufficient water flow. The bags are filled with one pair of socks, placed with the laundry into the washer and dryer thereby maintaining separation and eliminating the loss of socks. The pre and post sorting of socks will not be needed and the time spent to do this task is virtuously gone forever.

10 Claims, 7 Drawing Sheets

SOCK IN A SOCK

CROSS-REFERENCE TO RELATED APPLICATION

References Cited [Referenced By]

| U.S. Patent Documents | | | |
|---|---|---|---|
| 1962661 | June, 1934 | Kruschwitz | 248/100. |
| 2602482 | July, 1952 | Lyon | 383/117. |
| 2625973 | January, 1953 | Weldon et al. | 220/404. |
| 2636800 | April, 1953 | Downey | 220/400. |
| 2736454 | February, 1956 | McConnell | 220/404. |
| 2754991 | July, 1956 | Hagerty et al. | 220/481. |
| 2947464 | August, 1960 | Newton | 383/9. |
| 2964173 | December, 1960 | Schnabel | 220/481. |
| 3646723 | March, 1972 | Meroney | 383/9. |
| 4101104 | July, 1978 | Minard | 248/205. |
| 4175603 | November, 1979 | Iaboni | 383/9. |
| 4492169 | January, 1985 | Ware et al. | 248/222. |
| 4558800 | December, 1985 | Isgar et al. | 248/205. |
| 4630312 | December, 1986 | Milstein | 383/117. |
| 5050998 | September, 1991 | Wachtel | 383/9. |
| Foreign Patent Document | | | |
| 9005673 | May, 1990 | WO | 248/95. |

STATEMENT REGARDING FEDERALLY SPONSORED RESERCH OR DEVELOPMENT

"Not Applicable"

REFERENCE TO SEQUENCE LISTING, A TABLE, OR A COMPUTER

PROGRAM LISTING COMPACT DISC APPENDIX

"Not Applicable"

BACKGROUND OF THE INVENTION

The present invention relates to the orderly and organized storage of laundry items. More specifically, it relates to a convenient arrangement for preventing the loss of small laundry items.

In every household there exists the problem of keeping track of small laundry items, most problematic are the freewheeling socks. Everyone has met the sock monster, the unexplainable force that makes off with, most frequently, one sock of a matching pair. Usually, the sock turns up a short time later but more often than not after you has lost your need for it. The secret to this phenomenon starts with the pre-sorting of the dirty clothes. If the problem starts here it should be fixed here. This will be solved effortlessly by keeping matched pairs of socks together before the wash/dry process. This idea must be achieved with the thought of saving time and money.

A variety of bags have been developed for storage of laundry items U.S. Pat. No. 2,015,119 to McEwen discloses a laundry container having a large bag with a small bag permanently attached thereto. The McEwen invention was developed to be used by launderers cleaning laundry from a large variety of people. The large bag was for the larger clothes items while the smaller bag was for the smaller items. The smaller bag was not removable but acted as a process to wash all the laundry together yet keep it separated so that the smaller items were not lost. The invention is not for continuous storage until full, it pertains to use only at the time of wash.

U.S. Pat. No. Des. 134,134 to Kyle discloses a laundry basket apparently to be used with clothesline hanging. The basket has two open, non-washable pouches attached to the basket to store clothespins.

U.S. Pat. No. 2,602,482 to Lyon discloses a washing bag to be used with laundry. The bag is washable and sealable and made from a mesh-like material that withstands wear from washing. The bag is not attachable to any other surface and is generally for large laundry items.

U.S. Pat. No. Des. 294,757 to Kahane discloses a pocketed laundry bag for washing selected clothing. The mesh-like pattern was made to let water run freely thru to wash clothing effectively.

U.S. Pat. No. 4,228,834 to Desnick discloses a soap bag for storing soap in the bath. The bag is constructed from a mesh like material and has a strap/hook arrangement for hanging in the shower. It is not necessarily washable or durable for automatic wash. The open end is sealable.

Finally, U.S. Pat. No. 4,974,967 to Tsuyoshi discloses a laundry net for washing clothes maintained therein. The net is primarily for large clothes items having no means for separating the smaller items. The net is washable and sealable having a unique construction, which allows its contents to obtain equal washing from all positions.

SUMMARY OF THE INVENTION

The invention in the present application is directed to the combination of a hamper and a durable, washable, and sealable bag used for washing and drying small laundry items, most particularly socks. This object and others will become apparent hereinafter are attained, in accordance with the present invention with a washing bag composed of a mesh fabric.

In accordance with the invention, the bag comprises a washable mesh bag portion having one open end, which is sealable via a drawstring or zipper. The bag portion is formed from durable nylon mesh material wherein the openings forming the mesh are large enough to allow sufficient water flow for washing yet small enough to secure the contents within the bag. The instant invention's general structure features are to store multiple, individual pairs of socks, for the convenient use in the washing and drying process enabling socks to be paired together during the entire laundry process assuring that socks will never be lost and eliminates the need for sorting before and after the washing/drying process, saving time, money and the head ache of sorting individual socks. The invention consists of several bags on each side of a center webbing station. The invention will have various bag size capacity and vary on sock storage capabilities. The bag portions are formed and designed to fit a pair of socks. The bags can be sealed in various ways; although it's basic design will stay the same.

The bags of the instant invention are generally rectangular in plain shape and will include a cloth border at one end to be sewn to the center webbing. The bag will be fully accessible in a manner enabling a single pair of socks to be inserted into the bag.

The design closure to keep the socks in the mesh bag compartment will consist of a drawstring application. This will also be located at the top open end of the each individual sack. An elongated flexible cord is interlaced around the mesh within a sewn cloth housing. A simple spring loaded locking mechanism applied to the flexible cords releases to place a pair of socks in the mesh compartment then can be secured by pressing the locking mechanism closing the sack to keep the socks in place.

The next design closure to keep socks in the mesh sack compartment will consist of a zipper slide fastener and a cover to hide the zipper element to protect against premature unzipping and tangling. This also will be located at the top open end of each individual sack. The zipper element may have a lug and will have a cover arranged in overlapping portions so when the zipper is in the closed position it will uniformly hide the lug zipper element. The overlapping portions will be made of fabric.

The instant invention may also have a hanging feature at the ends of the center cloth. This feature accommodates needs to hang the invention in the closet next to your pants and shirts or behind a door for easy access. This invention can also be placed in the sock draw, confident when doing so, you will be rest assured that the socks match and the end of missing socks.

The bags and/or center cloth are color coded for families, with different colors corresponding to the owners (mother, father, daughter, son etc.). The Sock in a Sack comes in a variety range of colors.

Please note the design sketches at the end of this application for a more complete representation of this design. The instant invention will be applied in pairs to have the instant convenience of having a Sock in a Sack for clean socks and another for the dirty socks. This will insure that the cycle will stay continuous. The principals are to create and utilize a sock system that will eliminate the loss of socks eliminates pre/post sorting and this system will personalize socks, which seem to always end up in the wrong dresser draw.

As discussed below, the design parameters for this product are amenable to current production processes and tooling, and the materials specified are commonly available on the commercial level.

Due to the Sock in a Sack's very simple components, it should be no problem to produce from any technical standpoint, and existing assembly lines could be easily adapted for its speedy manufacture. The Sock in a Sack is cost effective, easy to use, affordable, durable and innovates the laundry process for commercial and residential consumers worldwide.

The instant invention provides the person doing the laundry with the advantage of pre-washing separation of socks and small laundry items from the large and also maintains this separation throughout washing and drying.

BRIEF DESCRIPTION OF THE DRAWING

The above and other objects, features and advantages of the present invention will become more readily apparent from the following description. For the purpose of illustrating the invention, reference being made to the accompanying drawings in which, it being understood that the invention is not intended to be limited to the precise arrangements and instrumentalities shown:

As shown in FIGS. 1 and 4 of the drawing, the bag or sack 2 is composed of an openwork fabric, i.e. a net, having its mouth at its upper end as shown at 3. The mouth 3 is bounded by a border 5, which will provide stability as can be seen in FIG. 1 AND 4 for this mouth of the bag.

Figure 2:
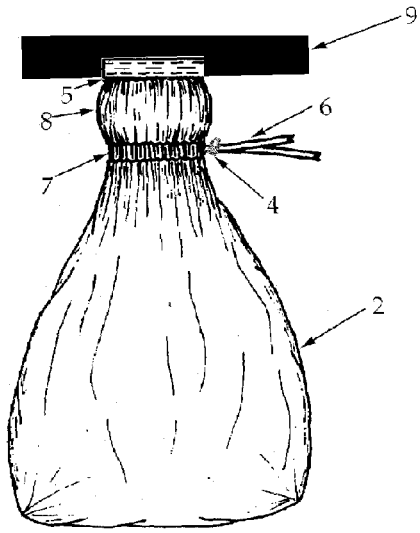
FIG. 2 is an elevational view, also in diagrammatic form, of the bag after filling.
Figure 4:
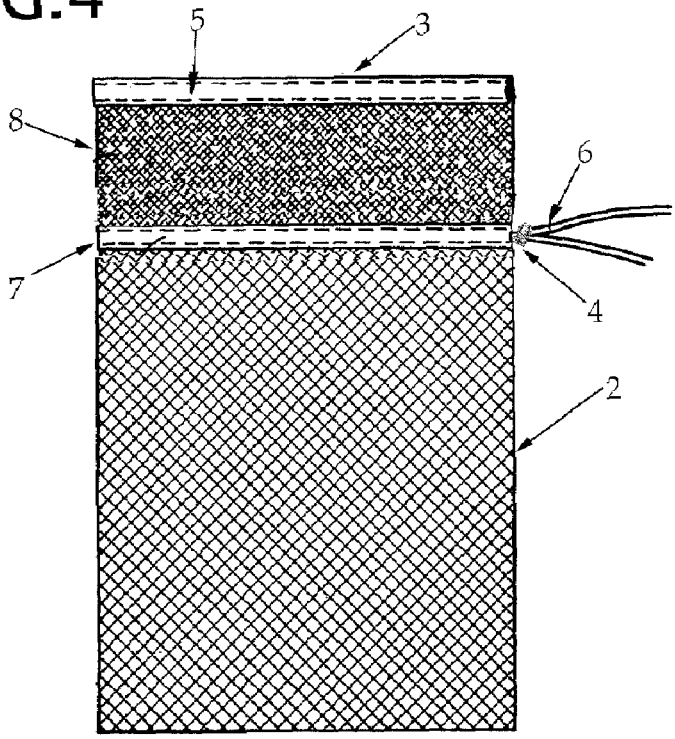
FIG. 4 is a view similar to FIG. 1 illustrating another embodiment of the invention also in diagrammatic form.

According to the invention, the bag is provided with a drawstring 6 spaced below the border 5 and received within a tubular sheath 7 stitched to the bag fabric so that a neck construction can be formed in the bag by tightening the drawstring 6 and shirring the sheath 7 as shown in FIG. 2.

The space within the bag between the border 5 and sheath 7 thus defines a space 8, which provides needed room to prevent bunching of the webbing 9 and border 5. This area, space 8, which is adapted to receive the webbing that will be sewn to border 5. A pair of socks or small laundry items is contained within the main compartment of the bag 2 below the drawstring 6. The border 5 will be sewn 3½ inches to the webbing FIG. 2.

The socks or the like are thus confined within the bag below sheath 7 (FIG. 2) and neither friction nor like action can cause the socks to work their way out of the sack 2 when the bag is placed in a tumbling or other type of washing machine.

Figure 1:
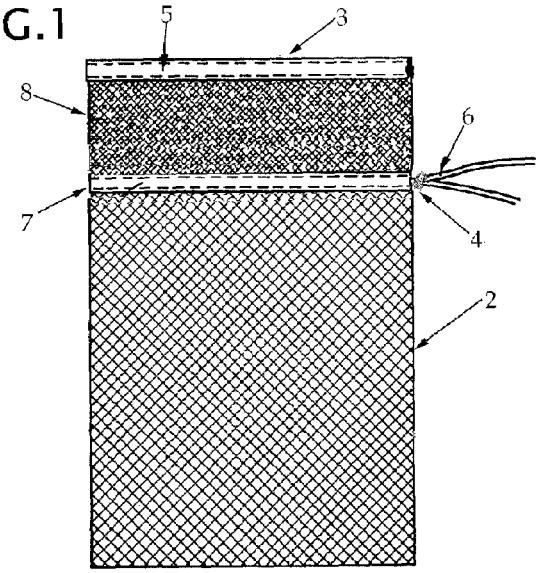
FIG. 1 is a schematic illustration of a flattened washing bag embodying the principles of the present invention.
Figure 3:
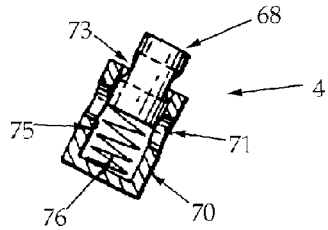
FIG. 3 is an enlarged side view partially broken away of a cord locking device comprising a component of the embodiment of the bag illustrated in FIG. 1, 2, 4.

As best seen in FIG. 3, the locking device 4, comprises a body 70 having a cord aperture 71 formed therethrough and a locking member 68 having a cord aperture 73 formed therethrough. The locking member 68 is slidably positioned in a bore 75 of body 70 and is normally biased in an upper position by a spring 76 so that the cord apertures 71, 73 are offset from each other. The locking members 68 of the lock device 4 are depressed against the force of respective springs 76 to bring apertures 71, 73 into alignment to receive a pair of the cord terminal end portions. When the locking members are released, the end portions of the cord are clamped together under the force of spring 76.

Thus, according to this embodiment, sliding the locking device 4 inwardly as shown in FIG. 2 will close the mouth 3 of bag 2. This shortens the length of the intermediate cord portions causing the sheath through which the cords pass to become gathered more closely together on the shortened cord intermediate portions thereby closing the bag mouth 3 in a drawstring fashion. To open the bag, it is only necessary to depress the locking members 68 of the lock device 4, and slide them outwardly on the cord terminal end portions. The cord terminal end portions may be knotted outwardly of the lock devices to prevent them from being pulled from the cords.

In use, after the socks are introduced into the bag with the drawstring open, the drawstring 6 is tightened using drawstring lock 4, whereupon securing items in sack 2 and sheath 7 is closed.

Upon removal of the cleaned articles, simply depress the drawstring lock device, which will release drawstring 6. The socks and the like can now be drawn from the bag.

Figure 5:
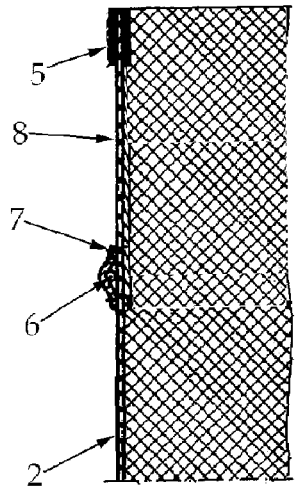
FIG. 5 is a cross section through the mouth region of a bag according to the invention, drawn to a larger scale than FIGS. 1 and 4 and also in highly diagrammatic form.

In the embodiment of FIG. 5, the fabric that makes border 5 and sheath 7 are designed with a cloth-like material. This flexible material reinforces the stability at the mouth opening, border 5 and also used to receive the drawstring within sheath 7. This lining is advantageously stitched to prevent crowding along the interior of the auxiliary space 8. Preferably the stitch seam that attach the border 5 and sheath 7 in place provides easy access, and stable construction.

Figure 6:
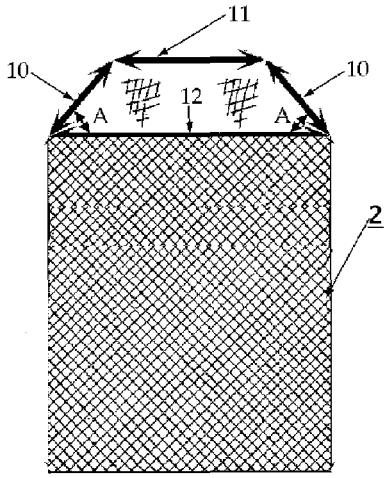
FIG. 6 is a schematic illustration of a flattened zipper-washing bag embodying the same principles of the present invention.
Figure 7:
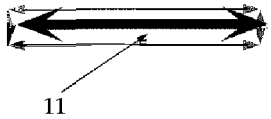
FIG. 7 is an enlarged front view of the top mesh region that will be sewn ½" to the webbing.
Figure 8:
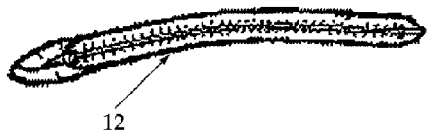
FIG. 8 is an enlarged view of the zipper
Figure 9:
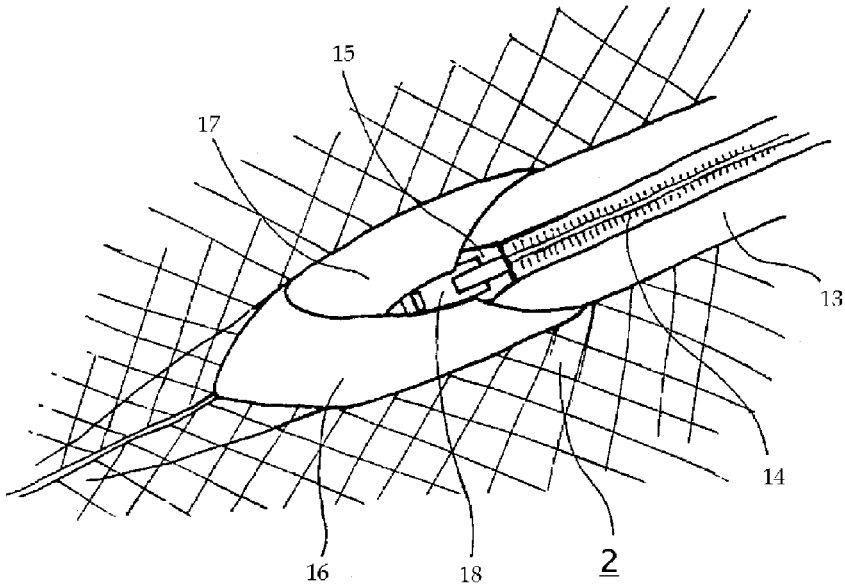
FIG. 9 is a fragmentary enlarged perspective view showing a slider of a slide fastener on which a cover is put.

FIG. 6 illustrates an embodiment of a laundry sack according to the present invention. A laundry sack of the illustrated embodiment includes a mesh body 2 comprising two top angled formations 10. This is done by tucking the mesh (10) inward 1½" (A) on both top sides leaving 3½" at the top 11 which will be sewn to the webbing 9. Formed into an angled shape 10 and so-constructed by stitching, resulting in a uniformed configuration that can now be sewn to the webbing 9. The zipper section 12 will be formed at the respective points, just below the constructed angle (A) to provide reinforcement and stability. The so-constructed angled shape 10 provides easier access to the bags contents. The tucked space (A) becomes evident when it is expanded. The top 3½ " mesh section 11 as shown in FIG. 7 provides an exploded view. This top 3½ mesh section 11 will be stitched ½" securely to the webbing 9. FIG. 8 shows and enlarged view of the zipper 12 to identify zipper 12 in FIG. 6. FIG. 9 provides an exploded view of the zipper 12 from here forth called a slide fastener including a slider 15 with a lug 18. The stitched section 13 is also provided with covers 16 and 17 for covering the slider 15 and lug 18 at the portion thereof at which the slide fastener 14 is positioned when the slide fastener 14 is closed. In the illustrated embodiment, the covers 16 and 17 each are made of fabric. The covers 16 and 17 are overlapped with each other at their proximal end as shown in FIG. 9, so that the slider 15 and lug 18 are covered with the so-formed overlap portion between both covers 16 and 17 when the slide fastener 14 is closed.

Now, the manner of operation of the so-constructed laundry sack of the illustrated embodiment will be described hereinafter.

First, the covers 16 and 17 are unfolded and then the lug 18 of the slider 15 is drawn out from the overlap portion of the covers 16 and 17 to move the slider, to thereby open the slide fastener 14. Subsequently, washing to be washed is received in the mesh body 2 and then the slide fastener 14 is closed. At this time, the slider 15 is covered with the covers 16 and 17 together with the lug 18. Thereafter, the laundry sack in which the washing is received is put in a washtub of a washing machine.

The mesh body 2, as described above, is formed into a rectangular shaped bag that expands at the angles 10 at the upper end of the bag. Such configuration of the sack body 2 permits water to constantly flow into the net body 2 and through the interior of the net body 2 irrespective of its position with respect to the flow of water in the wash tub of the washing machine, so that the washing in the net body 2 may be positively contacted with the flowing water, leading to effective removal of stain from the washing.

Figure 10:
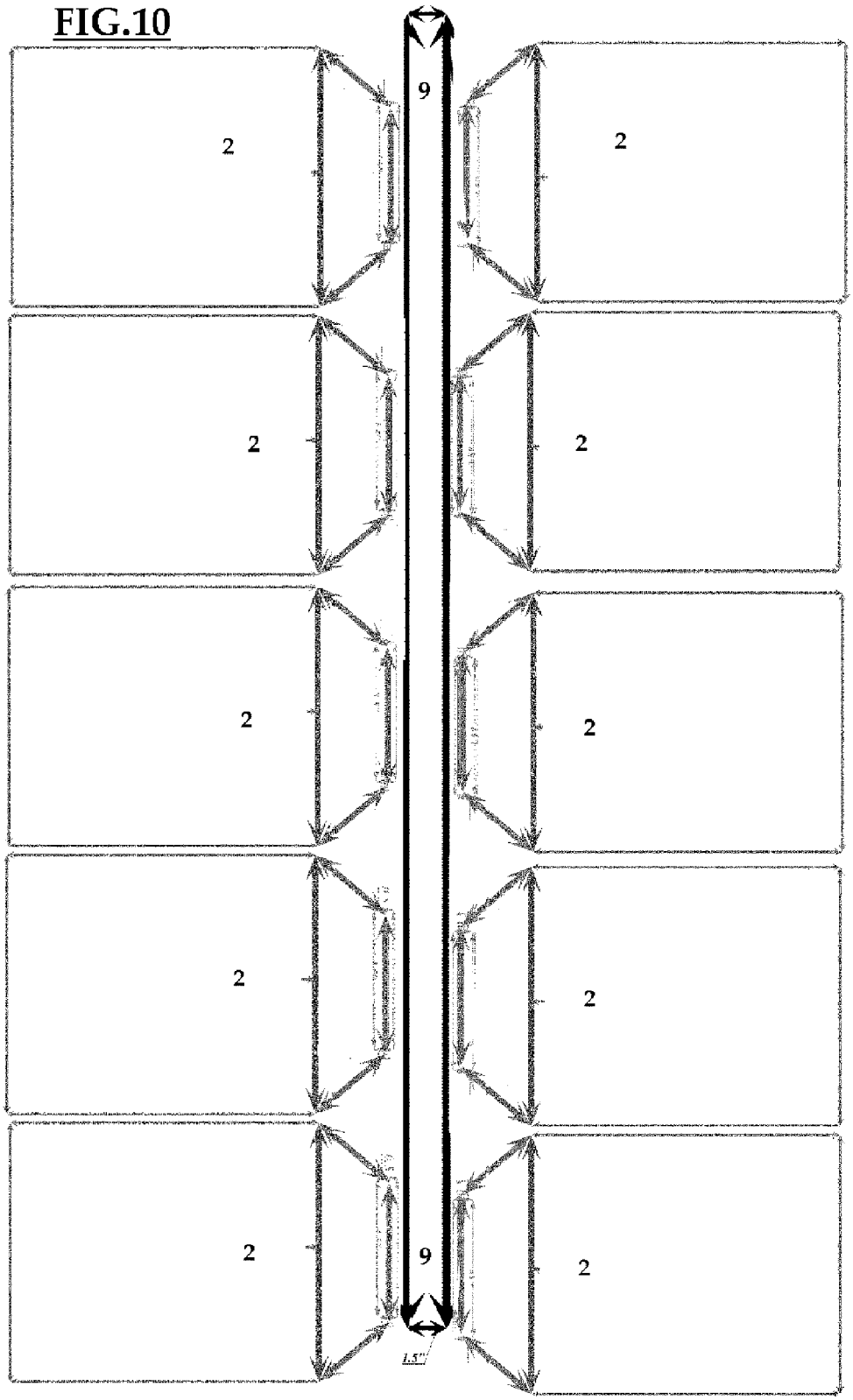
FIG. 10 is a schematic configuration, illustrating the basic setup and structure comprising said washing bag embodying the principles of the present invention.
Figure 11:
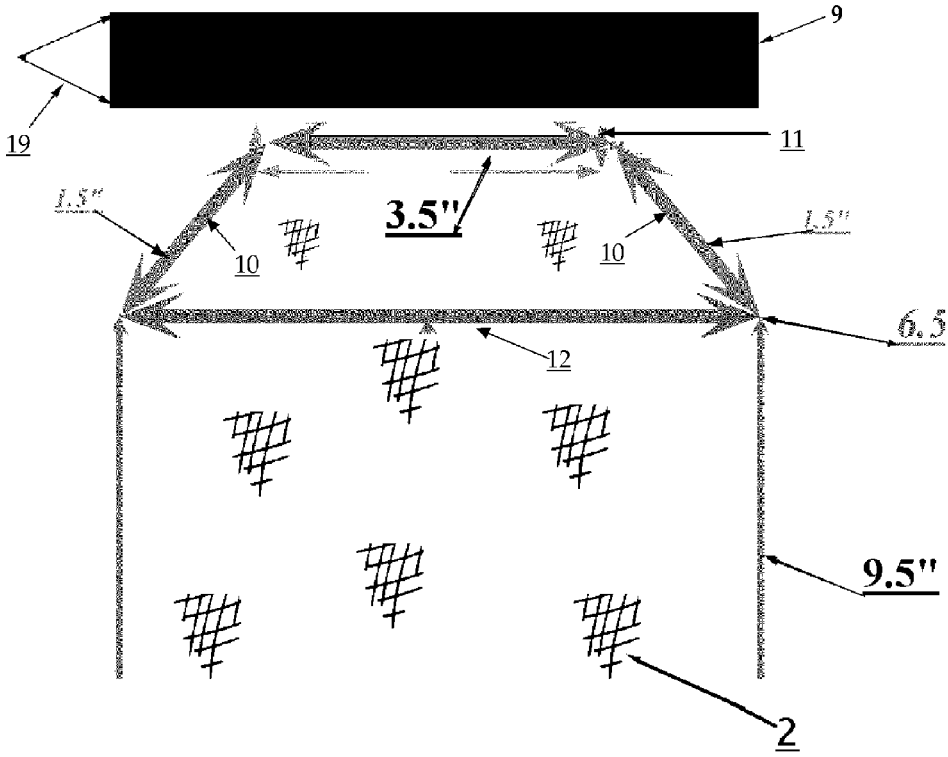
FIG. 11 is a fragmentary enlarged perspective view showing detailed measurements and a hanging device.

Also, the slider 15 and lug 18 of the slide fastener 14 mounted on the net body 2 is positively covered with the overlap portion of the covers 16 and 17, to thereby effectively prevent the slider 15 and lug 18 from damaging washing outside the laundry net. Referring now to FIG. 10 in accordance with the previous diagrams. Elements used to form the invention will be constructed from Mesh sacks 2 and a 1½" wide webbing 9 as shown in FIG. 10. The Sock in a Sack assembly designed FIG. 10 for individual pair of socks, are aligned uniformly sound. FIG. 10 allows a person of sound mind to visualize this invention for detail and essential attributes defining said invention. Both sacks (drawstring and zipper) have the same configuration FIG. 10, sewn 3½" at the top of the sacks to the webbing 9. Referring now to FIG. 11 for further details, with the mesh bag 2 being 9½" long from top to bottom, and width is approximately 6½". The zipper 12 is sewn 1½ down from the top 11. Also the mesh sack will be angled (10) 1½" on both topsides forming a 3½" mesh portion 11 that will be attached to the webbing 9. Referring to FIG. 11 a hanging device 19 will be attached to the webbing 9 to provide simple storage other than the sock draw.

Figure 12:
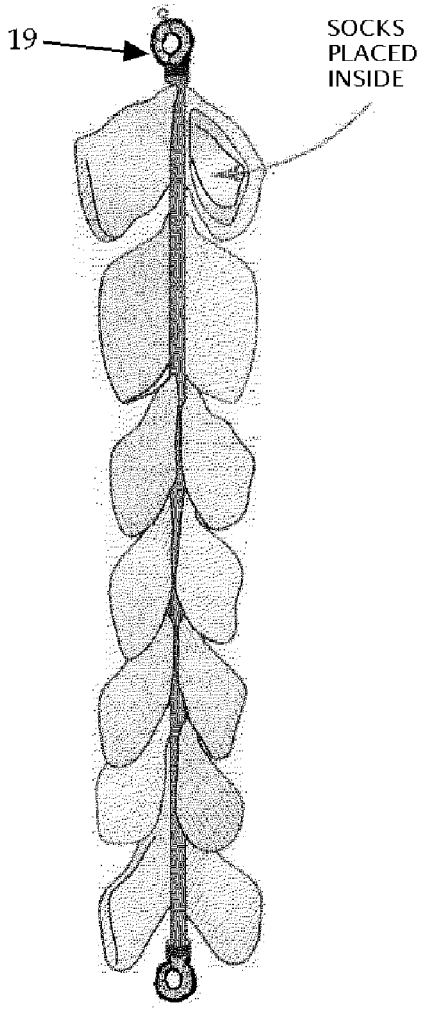
FIG. 12 is a drawing to visualize the invention as a whole for assembly purposes.
Figure 13:
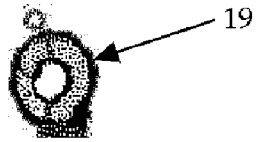
FIG. 13 is an enlarged front view of the hanging element.
Figure 14:
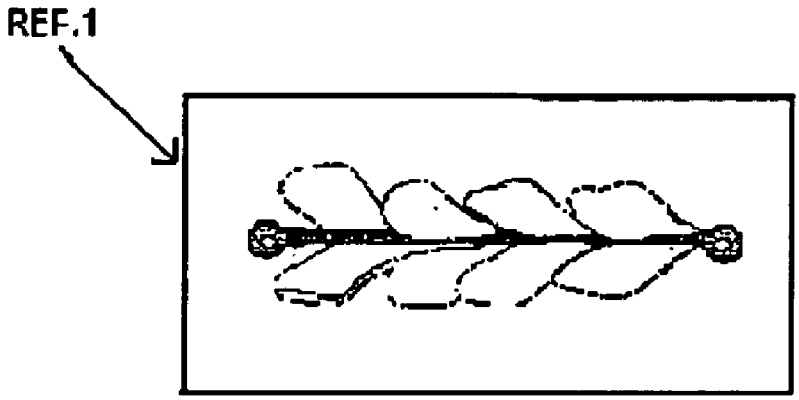
FIG. 14 is a view of the hamper.

FIG. 12 shows a perspective view of the Sock in a Sack. The invention's is design to essentially hold a pair of socks. It is displayed with a hanging device 19 showing the placement of sock storage. FIG. 13 is an exploded view of the hanging device 19 which will be used for additional storage options. FIG. 14 is a view of the hamper 1.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. An apparatus for storing and maintaining separation of pairs of socks or small laundry items from large laundry items prior to and during a washing and drying process comprising:

(a) a hamper, said hamper having an open end and at least one vertical side wall;

(b) a plurality of bags for holding socks or said small laundry items, said bag comprising a flexible bag portion having an open end for inserting a pair of socks or small laundry items therein and having means for closing said open end;

(c) a strip of webbing cloth said bags being sewn to said webbing adjacent said open end and evenly distributed along said webbing;

(d) a hanging element is permanently attached to a top end of the webbing.

2. The apparatus according to claim 1 wherein said webbing is formed of a durable material, which is washable, dryable and flexible in shape.

3. The apparatus according to claim 1 wherein said hanging element is comprised of strips of reinforced and durable material sewn at their ends with an opening there between.

4. The apparatus according to claim 1 wherein said bag portion is formed of a material, which is washable, dryable, durable and porous.

5. The apparatus according to claim 4 wherein said material is nylon having a mesh formation for allowing sufficient flow of water, soap and heating during said washing and drying process.

6. The apparatus according to claim 5 wherein said closing means comprises a zipper permanently attached to said bag.

7. The apparatus according to claim 6 wherein said zipper has a lug and a cover having overlapping portions so when the zipper is in a closed position the overlapping portions of the cover will uniformly hide the lug, the overlapping portions being made of fabric.

8. The apparatus according to claim 5 wherein said closing means comprises a drawstring permanently attached to said bag.

9. The apparatus according to claim 8 wherein said drawstring is received within a sheath sewn to said bag.

10. The apparatus according to claim 8 includes a durable drawstring lock to secure the drawstring firmly in place, effectively closing said bag.

* * * * *